US005764252A

United States Patent [19]

Burr et al.

[11] Patent Number: 5,764,252

[45] Date of Patent: Jun. 9, 1998

[54] METHOD AND APPARATUS FOR PRODUCING INK INTENSITY MODULATED INK JET PRINTING

[75] Inventors: Ronald F. Burr, Wilsonville; Wayne Jaeger, Beaverton; A. J. Rogers, West Linn; James D. Padgett, Portland; Hue P. Le, Heaverton; Jon C. Mutton, Portland, all of Oreg.

[73] Assignee: Tektronix, Inc., Wilsonville, Oreg.

[21] Appl. No.: 470,796

[22] Filed: Jun. 6, 1995

[51] Int. Cl.[6] ..... B41J 2/01

[52] U.S. Cl. ..... 347/20; 347/43; 347/84; 347/88

[58] Field of Search ..... 347/88, 99, 43, 347/20, 44, 48, 84

[56] References Cited

U.S. PATENT DOCUMENTS

| | | | |
|---|---|---|---|
| 3,946,398 | 3/1976 | Kyser et al. | 346/1 |
| 4,393,384 | 7/1983 | Kyser | 346/1.1 |
| 4,614,953 | 9/1986 | Lapeyre | 347/43 |
| 4,672,432 | 6/1987 | Sakurada et al. | 358/534 |
| 4,889,560 | 12/1989 | Jaeger et al. | 106/27 |
| 5,084,099 | 1/1992 | Jaeger et al. | 106/22 |
| 5,087,930 | 2/1992 | Roy et al. | 346/140 |

FOREIGN PATENT DOCUMENTS

| | | | |
|---|---|---|---|
| 3-284954 | 12/1991 | Japan | 347/87 |

*Primary Examiner*—John E. Barlow, Jr.
*Attorney, Agent, or Firm*—Ralph D'Alessandro; Janet Sleath

[57] ABSTRACT

Gray scale ink jet printing method and apparatus produce a high quality image having varying color intensities. This is achieved by mixing a colored phase change ink with varying amounts of a clear phase change ink base, thereby producing multiple gray scale levels of each color. The mixing either can be performed prior to placement of the phase change ink in the printer, or can be performed within the printer to produce different levels of color intensity during the printing process.

14 Claims, 2 Drawing Sheets

METHOD AND APPARATUS FOR PRODUCING INK INTENSITY MODULATED INK JET PRINTING

FIELD OF THE INVENTION

This invention relates to ink jet printing and more particularly to a method and an apparatus for providing images having color levels of varying intensity.

BACKGROUND OF THE INVENTION

Prior drop-on-demand ink jet printers typically employ one or more inks of a single intensity. Images are formed on a recording medium by ejecting drops of ink from an ink jet head onto the medium. Color ink jet printers typically use four subtractive primary colors of ink: cyan, magenta, yellow and black. Non-primary colors are produced by printing dots of different subtractive primary colors on top of one another. Modulation of the intensity of color of the printed image, hereinafter referred to as gray scale printing, is typically achieved by one of two methods: (1) modulating the diameter or size of each ink dot while leaving the number of dots within a specific area of the image unchanged; or (2) varying the number of dots printed in a specific area without changing the diameter of each individual dot.

Modulation of ink dot size entails controlling the volume of each drop of ink ejected by the ink jet head. The larger the dot size, the darker the color intensity of the printed image. Methods for modulating the volume of ink drops ejected from an ink jet print head are known in the art. For example, U.S. Pat. No. 3,946,398 describes a drop-on-demand ink jet print head that ejects ink drops of variable size in response to pressure pulses developed in an ink pressure chamber by a piezoceramic transducer (PZT). Ink drop volume is modulated by varying the amount of electrical waveform energy applied to the PZT for the generation of each pressure pulse. However, varying the ink drop volume causes variation in the ink drop ejection velocity resulting in drop landing position errors.

U.S. Pat. No. 4,393,384 describes a method for independently controlling both the drop volume and ejection velocity. In order to provide dots small enough for low intensity images, a very small ink jet orifice is required. Such an ink jet print head is difficult to manufacture and clogs easily.

Copending U.S. patent application. No. 07/892,494, now abandoned assigned to the assignee of the present application, describes a method for controlling the drop volume size and the drop ejection velocity by means of an electric field which accelerates the ink drops in inverse proportion to their volume, thereby reducing the effect of variations in ejection velocity. In addition, the electric field enables formation of an ink drop smaller than the orifice diameter. However, use of the electric field increases the complexity and cost of the printer.

Copending U.S. Pat. No. 5,495,270, issued Feb. 27, 1996; and assigned to the assignee of the present application, discloses an ink jet printer which produces ink drops of differing volumes having substantially the same ejection velocity by providing multiple PZT drive waveforms. The number of different ink drop sizes and therefore the number of gray scale levels which can be produced using this technique is very limited. In addition, the technology required to implement this method is quite complex.

In single ink dot size printing, the printer provides drops of one size which are large enough to provide adequate "solid fill" printing for a given resolution. Color intensity is manipulated by a process referred to as "dithering" in which the perceived intensity of an array of dots is modulated by selectively printing or not printing individual dots within an array. For example, if a 50 percent average intensity is desired, half of the dots in the array are printed. Multiple dither pattern dot densities are possible to provide a wide range of intensity levels. For a two-by-two dot array, four intensity level patterns are possible. An eight-by-eight dot array can produce 256 different intensity levels. Usable gradations of color in an image are thus achieved by distributing a myriad of appropriately dithered arrays across the recording medium in a predetermined arrangement.

However, with dithering there is a trade-off between the number of possible intensity levels and the size of the dot array required to achieve those levels. Increasing the size of the dither cell leads to loss of spatial accuracy due to the lower resolution of the dither patterns. This in turn results in printed images having a grainy appearance.

The Canon FP-510 printer employs ink drops of varying sizes to produce an image of varying color intensity. The Canon FP-510 also uses three different densities of liquid, water soluble cyan and magenta ink (thick, medium and light) to provide up to 64 color gradations. In addition to using liquid ink, the Canon FP-510 can be used only with specially coated roll paper, thereby limiting the versatility of the machine.

There thus continues to be a need in the art for a simple, inexpensive and easy-to-use ink jet printer which provides high-resolution gray scale printing without sacrificing performance and versatility of use.

SUMMARY OF THE INVENTION

An object of the present invention is to provide a gray scale ink jet printing method and apparatus that provides high quality images.

Another object of the present invention is to provide a gray scale ink jet printing method and apparatus that produces high quality images having a large number of different color intensities without the grainy appearance associated with dithering.

A further object of the present invention is to provide a high resolution gray scale ink jet printing method and apparatus which employs conventional ink jet print heads, thereby allowing the use of existing print head technologies.

Yet another object of the present invention is to provide such a method and apparatus which can be used to form images on any standard recording medium.

Still another object of the present invention is to provide a high resolution gray scale ink jet printer which is easy to use and requires little maintenance.

These and other objects are achieved according to the present invention by mixing a colored phase change ink with varying amounts of a clear ink base, thereby producing multiple gray scale levels of each color. The mixing either can be performed prior to placement of the phase change ink in the printer, or can take place within the printer to produce different levels of color intensity during the printing process.

In a first embodiment of the present invention, phase change inks having different gray scale levels are prepared by heating a colored phase change ink above its melting temperature. The molten ink is then mixed with a clear ink base containing no colorants and allowed to cool to room temperature to form a solid ingot of gray scale ink. By varying the ratio of colored ink base to clear ink base, different levels of color intensity are obtained. The resulting ingots of gray scale phase change ink are then employed in a standard phase change ink jet printer to produce high quality images.

In a second embodiment of the present invention, mixing of colored phase change inks with a clear ink base is performed within an ink jet printer. To provide a full spectrum of colors, four different subtractive primary colors of phase change ink (cyan, magenta, yellow, black) plus a clear ink base are placed in a standard phase change ink jet printer. Dilution of each colored ink takes place in a mixing chamber within the printer, with each mixing chamber being dedicated to producing one gray scale level of mixed ink. Mixed ink passes from the mixing chamber to a conventional ink jet head where a bank of image jets ejects the mixed ink drops onto the recording medium. Each bank of image jets is dedicated to a specific gray scale level of ink. Since each gray scale level is achieved with the same size drop, there is no need to vary the image jet design, such as the orifice size or internal jet design. The present invention can thus be readily utilized with existing ink jet printing technologies.

The above-mentioned and additional features of the present invention and the manner of obtaining them will be best understood by reference to the following more detailed description read in conjunction with the accompanying drawings.

DETAILED DESCRIPTION OF PREFERRED EMBODIMENTS

Figure 1:
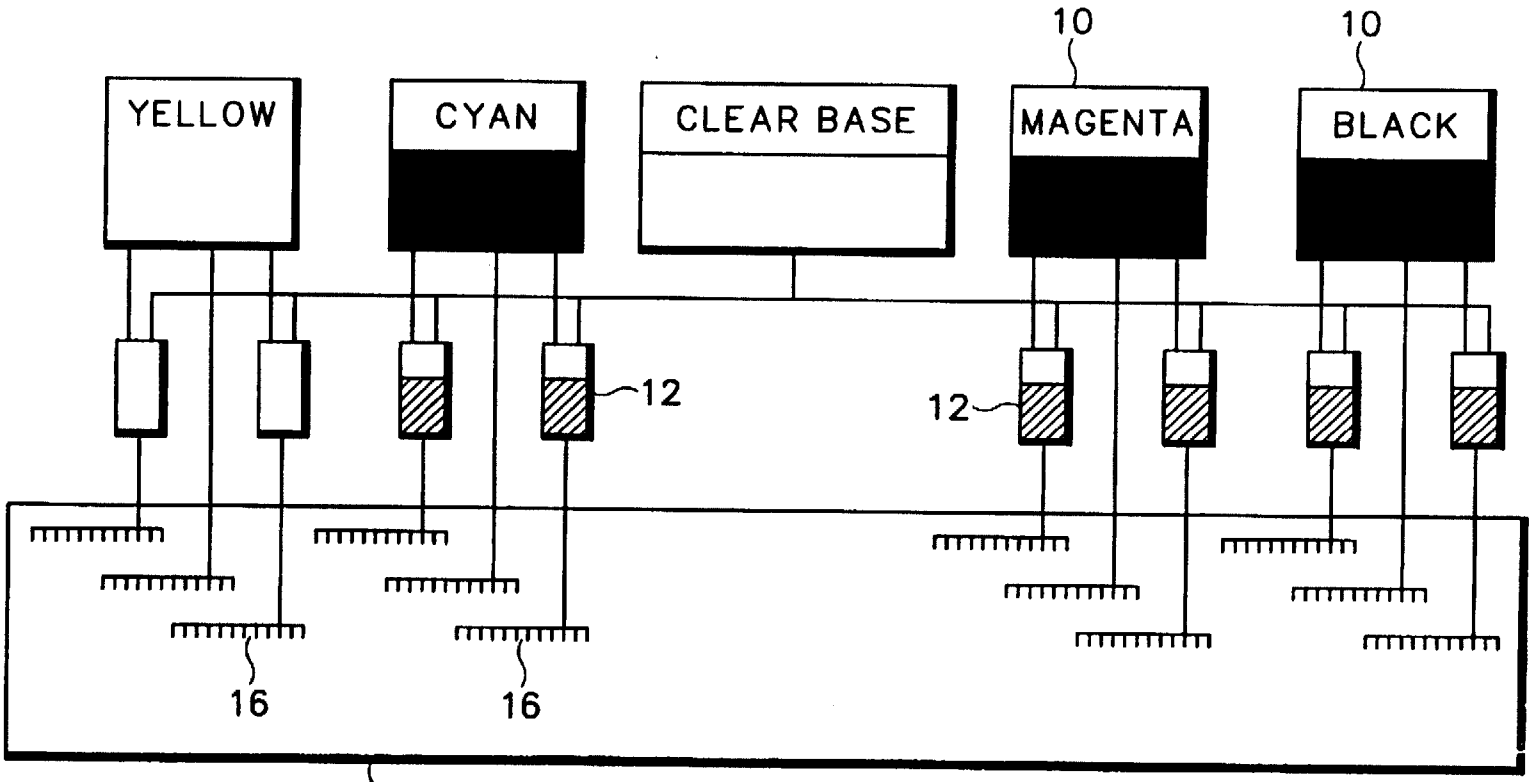
FIG. 1 is a schematic of a four level gray scale ink jet printer of the present invention.

The gray scale printing method and apparatus of the present invention employ phase change inks. These inks are in the solid phase at ambient temperature but exist in the liquid phase at the elevated operating temperature of an ink jet printer. In a typical phase change ink jet printer, solid ingots of phase change ink are placed in individual reservoirs. Once the printer is switched on, the ink is heated to above its melting temperature and is maintained in the stand-by phase at approximately 100° C. When the printer enters the ready phase, the ink is heated to approximately 120° C. and passed to the ink jet head, which is maintained at approximately 135° C.

Phase change inks offer several advantages over liquid, water-soluble inks. First, they are easy to store and to handle at room temperature. Second, the problem of nozzle clogging due to ink evaporation is largely eliminated, leading to improved reliability of the printer. In addition, the ink drops solidify immediately upon contact with the recording medium, thereby preventing migration of ink along the medium and improving image quality.

Preferred phase change inks for use in the present invention have high flexibility and high melting points, most preferably about 80° C., thereby improving the durability of the images formed from the inks. In addition, the preferred phase change inks demonstrate low melt viscosity, resulting in increased efficiency of the jetting process. Phase change inks suitable for use in the present invention include those described in U.S. Pat. Nos. 4,889,560 and 5,084,099, the disclosures of which are hereby incorporated by reference. Other phase change inks are known in the art and may be usefully employed with the present invention.

In a first embodiment of the present invention, ingots of phase change ink having different gray scale levels are prepared by first heating a colored phase change ink base above its melting temperature. The molten colored ink is then mixed with a clear ink base containing no colorants and allowed to cool to room temperature to form a solid ingot of gray scale ink. By varying the ratio of colored ink base to clear ink base, different levels of color intensity are obtained. The preferred ratio of colored ink base to clear ink base depends on many parameters, such as dye conditions including, for example dye tinctorial strength, drop mass and the kind of ink base used. For example, ratios of 1:4, 1:8, 1:16, 1:32 and 1:64 colored ink base to clear ink base may be used. The resulting ingots of gray scale phase change ink are then employed in a standard phase change ink jet printer, such as a Tektronix Phaser 300 (Wilsonville, Oreg.), to produce high resolution images.

High quality monochrome images may be formed according to this method by heating a black phase change ink base to its melting temperature and then diluting the ink with a clear ink base, thereby producing inks of different shades of gray. The resulting ingots of phase change inks are employed in a standard phase change ink jet printer to form high resolution monochrome images. This technique is particularly useful in medical imaging where a computer generated monochrome image can be printed directly onto a standard recording medium, such as a sheet of 8.5"×11" paper, thereby forming a high quality image which is both convenient to view and easy to handle.

In a second embodiment of the present invention, mixing of colored phase change inks with a clear ink base to provide gray scale levels is performed "on the fly" within a phase change ink jet printer. FIG. 1 is a schematic illustration of a four level gray scale ink jet printer of the present invention. Ingots of four different colors of phase change ink, namely cyan, magenta, yellow and black, together with a clear ink base are placed in the printer with each color being placed in a separate conventional ink reservoir 10. The ingots are heated to above the melting point of the inks using standard techniques, and the molten ink is pumped to mixing chambers 12, where colored ink is mixed with clear ink base to produce multiple gray scale levels. Each mixing chamber 12 is dedicated to producing one level of gray scale ink.

Different gray scale levels of ink are produced by varying the ratio of colored ink to clear ink base. For example, a 1:7 ratio of cyan ink to clear ink drops will give one gray scale level of cyan while a 1:32 ratio will give a lighter gray scale level of cyan.

From mixing chambers 12, gray scale level inks pass to print head 14 where ink dots are ejected from banks of image jets 16 onto a recording medium. Each bank of ink jets is preferably dedicated to one specific gray scale level of ink. An ink jet print head suitable for use with the present invention is disclosed in U.S. Pat. No. 5,087,930, assigned to the assignee of the present application. Other print head designs are well known in the art and may be usefully employed with the present invention.

While the embodiment of the present invention illustrated in FIG. 1 produces four gray scale levels of each color ink, it will be apparent to one of skill in the art that more or fewer mixing chambers can be employed to produce more or fewer gray scale levels. Similarly, fewer colors of inks may be placed in the printer to provide an image having a less than full range of color.

Figure 2A:
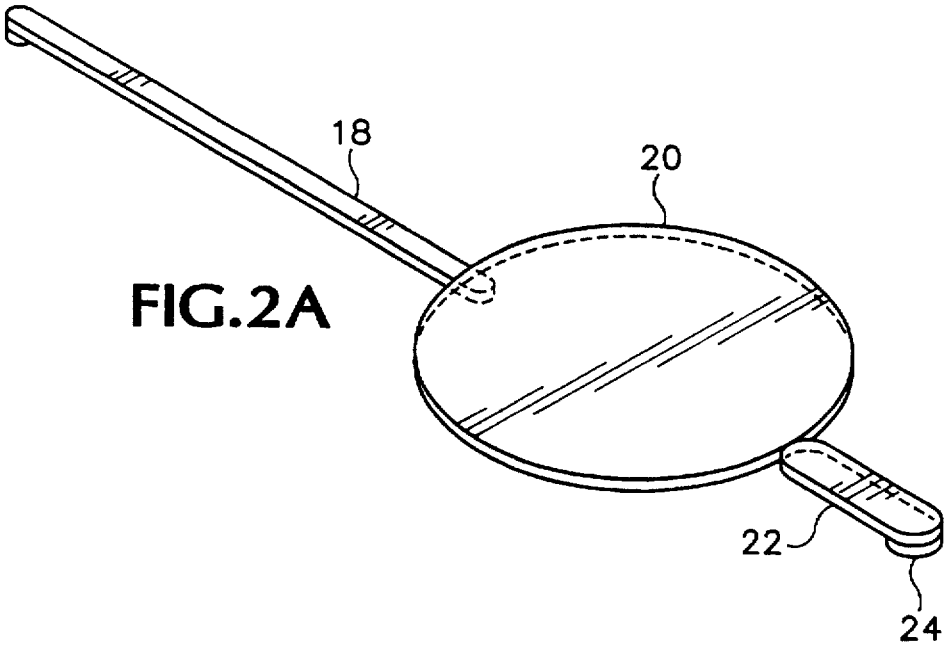
FIG. 2A is an isometric view of a mixing jet of the present invention.

Molten ink is pumped from reservoir 10 to mixing chamber 12 by means of a mixing jet. As shown in FIG. 2A, each mixing jet comprises an inlet channel 18, a pressure chamber 20, an outlet channel 22 with an orifice 24. Ink from reservoir 10 flows through inlet channel 18 and into pressure chamber 20. Ink leaves pressure chamber 20 by way of outlet channel 22 to orifice 24, from which ink drops are ejected.

Figure 2B:
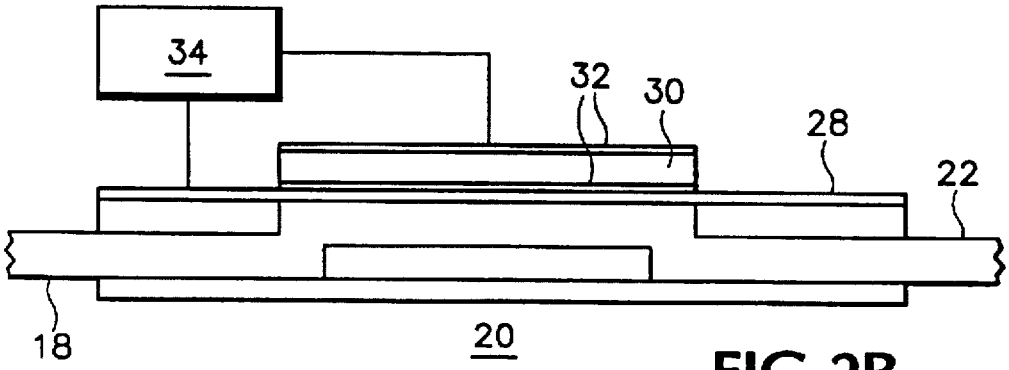
FIG. 2B is a cross-sectional view of a piezoelectric driver of the present invention.

Pressure chamber 20 is operated by an electromechanical transducer mechanism, such as a piezoelectric driver, as shown in FIG. 2B. Ink pressure chamber 20 is bound on one side by a flexible diaphragm 28. An electromechanical transducer 30, such as a PZT, is secured to diaphragm 28 and overlays pressure chamber 20. In a conventional manner, transducer 30 has metal film layers 32 to which an electronic transducer driver 34 is electrically connected. Transducer 30 is typically operated in its bending mode such that when a voltage is applied across metal film layers 32, transducer 30 attempts to change its dimensions. However, because it is rigidly attached to the diaphragm, transducer 30 bends, deforming diaphragm 28 and thereby displacing ink in pressure chamber 20, causing the outward flow of ink through outlet channel 22 to orifice 24. While this embodiment of the present invention has been described with reference to a specific pumping mechanism, other pumping mechanisms which may be usefully employed in this invention are well known in the art. Such pumping mechanisms include electromagnetic actuators, electrostatic ink jets or methods employing mechanical valves.

Figure 3:
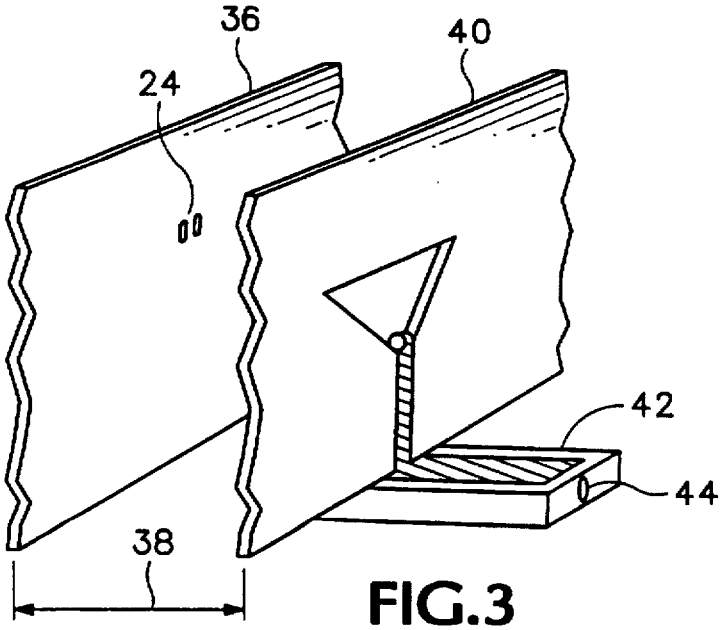
FIG. 3 is a fragmentary, isometric view of a mixing chamber of the present invention.

A mixing chamber of the present invention is illustrated in FIG. 3. Two mixing jets eject drops of ink from orifices 24 in an orifice plate 36 across an air gap 38 onto a mixing plate 40. One jet ejects colored ink while the other ejects clear ink base, thereby preventing the inks from diffusing back into ink reservoirs 10. The ink drops collect against mixing plate 40 and run into a secondary mixing chamber 42. The ink is thereby mixed at mixing plate 40 and in secondary mixing chamber 42. The mixed ink then passes through an aperture 44 to a standard ink jet print head (not shown). The ratio of colored ink to clear ink base is controlled by varying the frequency of the drive waveform applied to the PZT. This is easily achieved using software well known in the art.

To ensure efficient mixing of the colored ink and clear ink base, the drops ejected by the mixing jets are of a small volume, preferably in the range of about 100 to about 10,000 pl, more preferably in the range of about 500 to about 5,000 pl and most preferably in the range of about 1,000 to about 2,000 pl. To avoid pooling of the inks on mixing plate 40 and in secondary mixing chamber 42, secondary mixing chamber 42 preferably has a small volume. In a preferred embodiment, secondary mixing chamber 42 is about 0.508 cm deep and about 0.127 cm long, and narrows from a width of about 0.508 cm at the mixing plate end to about 0.127 cm at the outlet end.

The present invention is further illustrated by the following examples in which Example 1 describes the production of a high quality monochrome image using the first embodiment of the invention and Example 2 describes the design and testing of a mixer jet suitable for use in the second embodiment of the invention.

EXAMPLE 1

A high resolution monochrome image was formed according to the first embodiment of the present invention as follows.

A standard black phase change ink base (Tektronix, Wilsonville, Oreg.) was heated to approximately 135° C. and mixed with a clear ink base in the ratios of 1:4, 1:16 and 1:64 black ink base to clear ink base to produce three different shades of gray ink. The mixed inks were poured into molds and allowed to cool to room temperature. The resulting ingots of gray scale inks, together with an ingot of 100% full strength black phase change ink, were placed in a Tektronix Phaser 300 ink jet printer. A high quality monochrome print requiring no gamma correction was produced employing these gray scale inks.

EXAMPLE 2

A mixing jet for use in the present invention was designed as follows.

The necessary flow rate for each mixing chamber 12 is determined by the number of image jets which must be supplied, the repetition rate of the image jets, the size of the image drops and the repetition rate of the mixing jets. The maximum mass flow rate for each chamber would be a full page fill of a single gray scale color. Assuming that each mixing chamber supplies 16 image jets on a print head running in a 1 page per 2 minutes printing mode, generating 200 pl drops, the maximum required flow is calculated as follows:

$$V_{page}=(8.5\text{ in})(11\text{ in})(300\text{ dpi})^2(200\times10^{-12}\text{ l})(\underline{1000\text{ cm}^3})=1.68\text{ cm}^3$$

This in turn gives the following mass flow rate for each chamber:

$$m=(1.68\text{cm}^3)\frac{(0.85\text{g})}{\text{cm}^3}\ \frac{(1)}{2\text{min}}=11.9\frac{\text{mg}}{s}$$

This rate is approximately 9 times greater than the flow rate produce by standard image jets. For example, the image jets employed in a conventional print head typically have a flow rate of 1.4 mg/s. Using a one dimensional lumped parameter model, it was calculated that, in order to achieve the maximum required flow rate, a PZT drive with a diameter of 0.635 cm (0.250 in) that displaced 11,000 pl with a nominal ground to peak voltage of 60 volts would be required.

Using current jet design tools well known in the art, it was predicted that a mixing jet of the dimensions shown in Table 1 would produce 2200 pl drops at 2 kHz to give a mass flow rate of 3.8 mg/sec.

TABLE 1

All dimensions in cm

| Feature | Length | Width | Height | Cross Section |
|---|---|---|---|---|
| Inlet channel | 1.27 | 0.0254 | 0.0254 | Circular |
| Pressure chamber | 0.0254 | 0.635 | 0.635 | Circular |
| Outlet channel | 0.216 | 0.0635 | 0.0254 | Rectangular |
| Orifice | 0.01524 | 0.01524 | 0.01524 | Circular |

A mixing jet of these dimensions was constructed and found to produce 1400 pl drops at 1 kHz resulting in a mass flow rate of 1.2 mg/sec. This mass flow rate can be increased by modifying the mixing jet design to gain larger drops at a faster repetition rate or by increasing the number of mixing jets per mixing chamber.

Mixing jets of this design are employed to transfer clear ink base and a colored ink from conventional reservoirs to at least two, preferably four, mixing chambers, where the inks are mixed in the ratios of from about 1:1 to about 1:64 colored ink to clear ink base. The gray scale inks thus formed are passed to a standard ink jet print head and used to form high quality images of variable color intensities.

It should be noted that the present invention may be usefully employed in combination with various prior art techniques for obtaining variations in color intensity, including dithering and variation of ink drop size to provide enhanced gray scale image resolution and quality.

Although the present invention has been described in terms of specific embodiments, changes and modifications can be carried out without departing from the scope of the invention which is intended to be limited only by the scope of the appended claims. For example, a plurality of print heads could be employed with each print head communicating with its own separate and single mixing chamber.

We claim:

1. A method for generating a printed image having variable color intensities, comprising the steps of:

a) providing a clear phase change ink base and at least one colored phase change ink;

b) placing the clear phase change ink base in a first ink reservoir and the colored phase change ink in a second ink reservoir in a drop-on-demand phase change ink jet printer having a print head fluidically coupled to the ink reservoirs;

c) mixing the colored phase change ink with the clear phase change ink base in a ratio within the ink jet printer, wherein the ratio is selected to form a desired gray sale level ink by electing drops of the clear phase change ink from a first plate through a first orifice onto a second plate and ejecting drops of the colored phase change ink from a second orifice in the a plate onto the second plate such that the drops of clear phase change ink and the drops of colored phase change ink mix to form the gray scale level ink; and d) ejecting drops of the gray scale level ink from the print head onto a recording medium at a plurality of locations to generate an image having variable color intensities.

2. The method of claim 1 wherein each gray scale level ink is formed in a separate mixing chamber.

3. The method of claim 1 wherein the colored phase change ink and the clear phase change ink base are transferred from the first and second ink reservoirs to the mixing chambers by means of at least one mixing jet.

4. In a drop-on demand ink jet printer having a first ink reservoir for holding a clear phase change ink base, a second reservoir for holding a colored phase change ink and a print head fluidically coupled to the ink reservoirs for ejecting drops of ink onto a recording medium at a plurality of locations to generate a printed image, the improvement comprising:

a) means for transferring the clear phase change ink base from the first reservoir and the colored phase change ink from the second reservoir to a mixing chamber for mixing the clear phase change ink base and the colored phase change ink in a ratio, wherein the ratio is selected to form a desired gray scale level ink mixing chamber further comprising a first plate having a first and a second orifice, the first plate being mounted in front of and parallel to a second plate and being separated from the second plate by an air gap, and a secondary mixing chamber, whereby drops of clear phase change ink base ejected from the first orifice and drops of colored phase change ink base ejected from the second orifice pool on the second plate prior to being collected in the secondary mixing chamber; and b) means for transferring the gray scale level ink to the print head for generating an image having variable color intensities.

5. The drop-on-demand ink jet printer of claim 4 wherein the means for transferring ink from the first and second ink reservoirs to the mixing chamber comprises at least one mixing jet having a pumping mechanism, an inlet channel for transferring ink from the ink reservoir to the pumping mechanism and an outlet channel for transferring ink from the pumping mechanism to the mixing chamber.

6. The drop-on-demand ink jet printer of claim 5 wherein the pumping mechanism comprises a pressure chamber having a flexible diaphragm attached to one side, the flexible diaphragm having an electromechanical transducer attached thereto, whereby application of a voltage to the electromechanical transducer deforms the flexible diaphragm causing ink to be displaced from the pressure chamber through the outlet channel to the mixing chamber.

7. The drop-on-demand ink jet printer of claims 6 wherein the pressure chamber has a diameter of 0.635 cm.

8. A drop-on-demand ink jet printer for generating printed images having variable color intensities, comprising;

a) a first ink reservoir for holding a clear phase change ink base and a second ink reservoir for holding a colored phase change ink;

b) a mixing chamber with a first plate having a first and a second orifice for mixing the clear phase change ink base and the colored phase change ink in a specific ratio wherein the ratio is selected to form a desired gray scale level ink the first plate being mounted in front of and parallel to a second plate and being separated from the second plate by an air gap a first mixing jet ejecting drops of clear phase change ink from the first orifice onto the second plate and a second mixing jet for ejecting drops of the colored phase change ink from the second orifice onto the second plate such that the drops of the clear phase change ink and the colored phase change ink are pooled on the second plate; and c) means for transferring the gray scale level ink to a print head for ejecting drops of the gray scale level ink onto a recording medium at a plurality of locations to generate a printed image.

9. The drop-on-demand ink jet printer of claim 8 wherein the mixing chamber additionally comprises a secondary mixing chamber for collecting drops of ink ejected from the first and second orifices and pooled on the second plate.

10. The drop-on-demand ink jet printer of claim 8 additionally comprising a plurality of mixing chambers for mixing a plurality of gray scale level inks.

11. The drop-on-demand ink jet printer of claim 10 additionally comprising a plurality of print heads, each print head communicating with a single mixing chamber.

12. The drop-on-demand ink jet printer of claim 8 wherein the mixing jet comprises a pumping mechanism, an inlet channel for transferring ink from the ink reservoir to the pumping mechanism and an outlet channel for transferring ink from the pumping mechanism to the mixing chamber.

13. The drop-on-demand ink jet printer of claim 12 wherein the pumping mechanism comprises a pressure chamber having a flexible diaphragm attached to one side, the flexible diaphragm having an electromechanical transducer attached thereto, whereby application of a voltage to the electromechanical transducer deforms the flexible diaphragm causing ink to be displaced from the pressure chamber through the outlet channel to the mixing chamber.

14. The drop-on-demand ink jet printer of claim 13 wherein the pressure chamber has a diameter of about 0.635 cm.

* * * * *

UNITED STATES PATENT AND TRADEMARK OFFICE

CERTIFICATE OF CORRECTION

PATENT NO : 5, 764,252
DATED : June 9, 1998
INVENTOR(S) : Ronald F. Burr, et al.

It is certified that error appears in the above-identified patent and that said Letters Patent is hereby corrected as shown below:

Column 7, line 29 (claim 1) change "sale" to --scale-- and change "electing" to --ejecting--; and
line 32 change "a" to --first--.

Column 7, line 58 (claim 4) after "ink" insert --, the--.

Column 8, line 28 (claim 8) after "ink" insert --,-- and
line 30 after "gap" insert --,--.

Signed and Sealed this
Seventh Day of March, 2000

*Attest:*

*Attesting Officer*

Q. TODD DICKINSON

*Commissioner of Patents and Trademarks*